US006539982B1

(12) United States Patent
De Swart

(10) Patent No.: US 6,539,982 B1
(45) Date of Patent: Apr. 1, 2003

(54) LOOM WITH AN INSERTION BRAKE

(75) Inventor: Gijsbertus De Swart, Eindhoven (NL)

(73) Assignee: Te Strake Textile B.V., Deurne (NL)

( * ) Notice: Subject to any disclaimer, the term of this patent is extended or adjusted under 35 U.S.C. 154(b) by 0 days.

(21) Appl. No.: 09/889,562

(22) PCT Filed: Jan. 21, 2000

(86) PCT No.: PCT/NL00/00047

§ 371 (c)(1),
(2), (4) Date: Oct. 19, 2001

(87) PCT Pub. No.: WO00/44970

PCT Pub. Date: Aug. 3, 2000

(30) Foreign Application Priority Data

Jan. 29, 1999 (NL) ..... 1011171

(51) Int. Cl.[7] ..... D03D 47/34; B65H 59/30
(52) U.S. Cl. ..... 139/194; 139/453; 242/421
(58) Field of Search ..... 139/194, 453; 242/421

(56) References Cited

U.S. PATENT DOCUMENTS 4,010,915 A * 3/1977 Strutz et al. ..... 242/147 R
4,998,420 A * 3/1991 Scavino ..... 139/453
5,329,822 A * 7/1994 Hartel ..... 73/862.61
5,842,661 A * 12/1998 Hohne et al. ..... 242/419.1
6,105,627 A * 8/2000 Covelli ..... 139/450

* cited by examiner

*Primary Examiner*—John J. Calvert
*Assistant Examiner*—Robert H. Muromoto
(74) *Attorney, Agent, or Firm*—Jacobson Holman PLLC

(57) ABSTRACT

A loom with an insertion brake disposed between a yarn feeder and the shed of the loom, which insertion includes a movable brake element, which is capable of movement between two fixedly disposed yarn guides from a position of rest on one side of the yarn to an operative position on the other side of the yarn. The movable brake element is connected to a driving motor, the excitation of which is controlled by an electronic system, in which at least one program for the time and the position of the movable brake element is incorporated. The electronic system includes a position detection sensor for sensing the instantaneous position of the brake element. The electronic system compares the instantaneous brake element position with the position which is desired according to the program and, if a deviation is established between the sensed instantaneous position and the desired position, controls the amount of current being supplied to the motor in such a manner that the deviation is at least largely eliminated in combination with the reactive force of the yarn.

6 Claims, 4 Drawing Sheets

R
S

LOOM WITH AN INSERTION BRAKE

This is a nationalization of PCT/NL00/00047, filed Jan. 21, 2000 and published in English.

FIELD OF THE INVENTION

The present invention relates to a loom with an insertion brake which is disposed between a yarn feeder and the shed of the loom, which insertion brake comprises a movable brake element, which is capable of movement between two fixedly disposed yarn guides from a position of rest on one side of the yarn to an operative position on the other side of the yarn, wherein the movable brake element is connected to a driving motor, the excitation of which is controlled by an electronic system, wherein at least one programme for the time and the position of the movable brake element is incorporated in said electronic system.

BACKGROUND OF THE INVENTION

In looms, in particular air looms, the weft yarn is carried into the shed from a yarn feeder at a high velocity during the insertion process. Near the end of the insertion process, the yarn movement is braked abruptly by a braking element on the yarn feeder, wherein the kinetic energy contained in the weft yarn is converted into tension energy in the yarn. High tension peaks may occur in the yarn thereby, which may have various undesirable consequences and which may in some cases even lead to yarn breakage.

In order to obviate the occurrence of such a tension peak and/or damp it at least partially, EP 0 356 380 discloses a loom wherein an insertion brake is disposed between the yarn feeder and the shed of the loom, which insertion brake comprises a driven, movable brake element, which is capable of movement between two fixed yarn guides from a position of rest, wherein the yarn is not passed over the fixed yarn guides, or only to a small extent, to an operative position, wherein the yarn is passed over the yarn guides to a greater extent. The movable brake element is thereby driven in such a manner that the brake element is first moved from its position of rest to a maximum stroke position at the end of the insertion process or shortly therebefore. Then the brake element is returned from its maximum stroke position to a reduced stroke position under the influence of the reactive force of the yarn, wherein the kinetic energy contained in the yarn is reduced and the occurrence of a tension peak is obviated or at least damped. In the prior art loom all this is according to one embodiment achieved in that the movable brake element comprises an elastic part, which is pressed down by the reactive force of the yarn following a maximum stroke of the brake element, whereby kinetic energy from the yarn is stored in said elastic parts In another embodiment, the brake element is controlled by a linear magnetic motor, which is so controlled that the brake element is only moved to its maximum stroke position upon major excitation of the motor, after which the degree of excitation is reduced and the reactive force of the yarn is capable of returning the brake element against the motor force, whereby reduction of kinetic energy in the yarn takes place again, so that the tension peak is damped in this manner as well. In both embodiments an interaction between the reactive force of the yarn and a mechanical or electrical force of the brake element takes place, therefore. This interaction may lead to malfunction, especially at higher operating speeds of the loom, so that an optimum damping of the tension peak that occurs cannot be achieved.

Another embodiment of a loom of the kind to which the present invention relates is disclosed in EP 0 155 431. In this prior art loom, the brake element which is capable of movement between two fixed guides is a lever, whose movements are controlled by a cam driving unit. A position-time diagram is stored on the circumferential surface of the cam in question, according to which the movable brake element's positions are controlled during the insertion process. Such mechanical control of the movable brake element is satisfactory per se for lower-speed looms, but one drawback is the fact that constantly the same position-time diagram is gone through for each insertion. Generally such mechanical control is not sufficiently flexible for quickly varying operating conditions, whilst it is furthermore difficult to adapt to varying yarn qualities, for example. Furthermore, this mechanical control of the brake element is fairly inelastic (rigid), so that problems may arise in case of sudden thickenings in the yarn.

In order to make a loom of the above kind more flexible and more easily adaptable to varying operating conditions, EP 0 605 531 presents a loom wherein the movable brake element is driven by a fast-response stepping motor or DC motor, which is controlled by an electronic control device, which comprises a programme section incorporating a variable programme for time and position of the brake element, at least between insertions. The connection between the motor and the brake element is inelastic thereby, and the driving force of the motor is larger than the maximum reactive force of the yarn at all times, so that it is possible to go through any position-time diagram for the brake element that may be desired. One drawback of this prior art loom is the fact that the brake element control is still rigid, so that problems may arise after all when sudden thickenings are encountered in the yarn.

From Dutch laid-open patent application No. 6712481 a yarn brake is known which comprises a stationary brake element and a movable brake element. The movable brake element is thereby driven by a moving coil motor, which is excited via an electronic system, wherein a position detection sensor is incorporated in the electronic system, which position detection sensor senses the instantaneous position of the movable brake element. The amount of current being supplied to the moving coil motor thereby depends on the position of the movable brake element as sensed by the position detection sensor, all this in such a manner that the final tension of the yarn will remain constant, also in the case of variations in the initial tension. This yarn brake is a genuine yarn tension regulating device, therefore.

Another device for regulating the yarn tension in looms is disclosed in EP 0 467 059. In this device the movable brake element is a two-armed rotary lever, one end of which is movable between two fixed yarn guides and the other end of which carries a magnet coil, which co-acts with two spaced permanent magnets of a linear electric motor. In a lever position wherein the yarn is passed over the fixed guides, said permanent magnets produce an effect like a spring. The yarn tension thereby exerts a reactive force on the lever, which is compensated by the degree of excitation of the linear electric motor. The instantaneous yarn tension is calculated on the basis of the degree of excitation of the linear electric motor. The electronic control system for the linear motor furthermore includes a position detection sensor, which continuously senses the instantaneous position of the lever. The instantaneous yarn tension calculated from the degree of excitation of the linear motor is compared with a desired yarn tension for each position, and in case of a deviation the degree of excitation of the linear motor is changed. Thus the yarn tension can be regulated in such a manner that it conforms to a specific desired position-tension diagram. Furthermore the linear motor of this prior art device can also be excited in such a manner that the brake element takes up positions which are required for drawing back the yarn at the end of the insertion process.

SUMMARY OF THE INVENTION

The object of the present invention is to provide a loom wherein the movable brake element is controlled in a flexible and very precise manner whilst exhibiting sufficient elasticity to be able to cope with sudden variations in the yarn quality or the yarn thickness.

In order to accomplish that objective, the loom according to the invention is characterized in that the electronic system comprises a position detection sensor for sensing the instantaneous position of the brake element, wherein the electronic system compares the instantaneous brake element position with the position which is desired according to the programme and, if a deviation is established between the sensed instantaneous position and the desired position, controls the amount of current being supplied to the motor in such a manner that said deviation is at least largely eliminated in cooperation with the reactive force of the yarn.

The brake element used in the loom according to the invention can be driven by any type of electric motor, wherein the force to be exerted by the motor upon movement in the direction of its maximum stroke position only needs to be a little larger than the reactive force exerted by the yarn, whilst the motor force may even be smaller than the reactive force of the yarn upon return of the brake element from its maximum stroke position, whereby the reactive force of the yarn causes the brake element to move back. Possibly, a negative motor force can be employed, if desired, so that the return movement of the brake element is not only the result of the reactive force of the yarn, but it is also assisted by the motor. As a result, the return movement of the brake element will take place at a higher velocity. The electronic system controls the motor force in such a manner that the brake element position sensed by the sensor is compared continuously or at intervals with the position as desired by the programme, and in that the motor force is so controlled in case of a deviation that this deviation is eliminated. In this manner the desired position-time diagram of the movable brake element is followed precisely, whilst the brake element is not controlled in an undesirable, rigid manner. Sudden thickenings that may occur in the yarn can effect an instantaneous movement of the brake element, with a deviation occurring between the desired position and the instantaneous position, which deviation is subsequently eliminated. Yarn breakage will be rare.

Any suitable type of motor, for example a hydraulic, pneumatic or electric motor, can be used for driving the brake element.

According to another embodiment, the movable brake element is made up of one end of a lever which is rotatable about a shaft, wherein said shaft is linked to a rotary solenoid motor. The advantage of such a motor is its low moment of mass inertia and short response time.

Another advantageous embodiment, wherein the movable brake element is moved from its position of rest to its maximum stroke position shortly before the end of the insertion process, is characterized in that the electronic system excites the driving motor sooner and/or more strongly as the end of the insertion process comes earlier, so that the maximum stroke position is reached more quickly. In this manner it is achieved that the maximum stroke position is reached sooner at higher yarn speeds, so that the reduction of the kinetic energy contained in the yarn is initiated sooner, so that the feared tension peak will be damped in time and to a sufficient degree at higher yarn speeds as well. The use of a yarn winding counter on the yarn feeder makes it possible to count the number of windings being unwound from the yarn feeder, wherein, when detection of a predetermined number of windings being reached before the end of the insertion process causes the electronic system to excite the movable brake element. In this manner it is possible during the insertion process already to adjust the moment of driving of the brake element to the fact that the end of the insertion process will be reached sooner or later.

Another advantageous embodiment of the loom according to the invention is characterized in that the mass inertia of the movable brake has been selected to be so low that the force being exerted on the brake element is capable of moving the brake element upon detection of irregularities in the yarn. It is noted that the term mass inertia of the movable brake element is to be understood to mean the mass inertia of the brake element itself and also of all the parts connected thereto. In this manner it is achieved that a thickening that may occur in the yarn will be capable of moving the brake element when it strikes against said brake element, which movement will be sensed by the position detection sensor, after which the control system will directly eliminate the deviation between the desired position and the instantaneous position. A thickening or other yarn irregularity can thus pass the brake element practically without impediment, without this leading to impermissibly high tension peaks in the yarn.

In looms comprising insertion brakes of the kind to which the present invention relates, the position detection sensor produces an electric signal of a specific magnitude for every current position of the brake element. The control system recognises these electric signals as a measure of a specific current position of the brake element. This means, therefore, that an electric sensor signal of one specific magnitude is associated with every current position of the brake element. A problem which occurs thereby is that the sensors that are used may exhibit a certain deviation in the magnitude of the signals they generate. This might lead to one sensor generating a signal of a different magnitude than another sensor in one specific current position of the brake element, therefore, causing the control system to derive therefrom a position which does not exactly correspond to the current position of the brake element. In order to overcome this problem, another embodiment of the insertion brake according to the invention is characterized in that the movable brake element is capable of movement between a first stop and a second stop, and in that the electronic system includes a control module for adjusting the position detection sensor, wherein the control module first stores a first signal from the position detection sensor when the brake element abuts against said first stop, and then records a second signal when the brake element abuts against said second stop, storing the difference between said first and said second signal as a maximum (100%) value of the path through which the brake element can travel, after which the module in use converts the signals from the sensor associated with the instantaneous positions of the brake element to a percentage of said difference signal, from which the instantaneous position of the brake element follows as a percentage, of the maximum stroke position of the brake element, which momentary position is compared with the desired position by the electronic system.

When the insertion brake is placed into service or when the sensor is replaced, the brake is first moved to a position wherein it abuts against the first stop (minimum stroke position), after which the first signal delivered by the position detection sensor is recorded by the control module. Then the brake is moved to a position wherein the brake element abuts against the second position and the second signal delivered by the position detection sensor is recorded again. The control module then determines the difference between the first and the second signal, which difference will be a measure for the spacing between the first and the second stop.

Following that, the brake can be placed into service. In a specific position of the brake element, the position detection sensor will now deliver a signal which is related to the stored difference signal in the control module and which is converted into a percentage of said difference signal. Accordingly, this percentage is also a percentage of the difference between the minimum (abutment against the first stop) and the maximum (abutment against the second stop) position of the brake element. In this manner reliable information as to the instantaneous position is obtained.

The position detection sensors can thus be adjusted easily and quickly before being placed into service, so that any differences in their operation will not effect the further control system of the brake.

It is noted that the brake element is only brought into contact with the said two stops when the sensor is being adjusted. During the further operation of the brake, the brake element will move within an range of 20–80% of the maximum stroke position between said stops.

In order to be able to verify whether a specific insertion brake is still functioning sufficiently quickly and accurately after some time, a further embodiment of the movable brake element is arranged for verifying whether the movable brake element has completed a specific position change within a specific period of time with a predetermined degree of excitation. For example, it is possible to verify therewith whether the brake element has completed a position change of 50–80% within a specific period of time with a predetermined degree of excitation. This verification preferably takes place in a range of movement of the brake element in which there will be no influencing by the yarn. Thus it is possible to establish in a simple manner whether the friction has so increased, for example due to fouling or otherwise, that the insertion brake no longer meets the requirements made thereof.

BRIEF DESCRIPTION OF THE DRAWINGS

The invention will now be explained in more detail with reference to an embodiment.

DETAILED DESCRIPTION OF THE PREFERRED EMBODIMENTS

Figure 1:
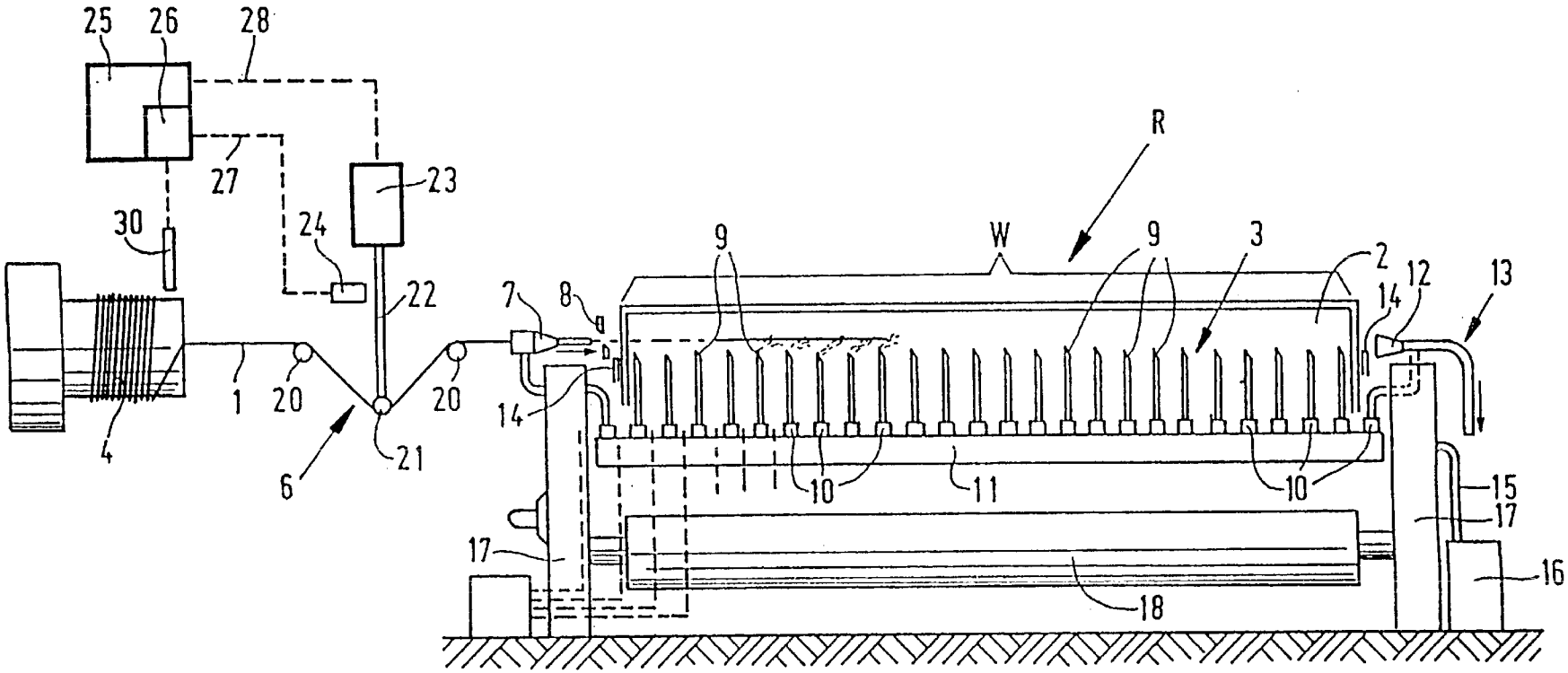
FIG. 1 is a schematic front view of an air jet loom.

In an air jet loom R, a weft yarn 1 is fed from a supply drum 4, via an insertion brake 6, to a main injector 7. The main injector 7 feeds the yarn 1 past scissors 8 to the shed 3 formed by the warp yarns 2, which has a width W. Auxiliary blow pipes 9, which are connected to a compressed air pipe 11 via magnetic valves 10, assist the transport of the weft yarn through shed 3. After the end of the weft yarn 1 has left shed 3, it enters the funnel 12 of an extractor 13 and is cut off, wherein the two yarn ends are laid into selvedge devices 14 disposed on either side of the shed. The figure furthermore shows that the compressed air pipe 11 is connected to a compressed air generator 16 via a pipe 15, whilst the figure also shows a drum 18 for the finished product, which drum is disposed between side walls 17.

Insertion brake 6 is built up of 2 fixedly disposed yarn guides 20, between which a movable brake element 21 is disposed. The movable brake element 21 is connected to a driving device 23 via a lever 23. The insertion brake 6 furthermore comprises a sensor 24 for sensing the instantaneous position of the movable brake element 21. The loom furthermore comprises an electronic control device 25, which includes a programme section 26 in which at least one time-position programme for the movable brake element 21 is stored. The position detection sensor 24 continuously transmits the sensed instantaneous position of the movable brake element 21 to the electronic control device 25 via line 27, which control device 25 compares said instantaneous position with the desired position in programme section 26, after which, in case of a deviation between the sensed instantaneous position and the desired position, the electronic device varies the excitation of the driving device 23 via line 28 in such a manner that the detected deviation is at least substantially eliminated.

A stop element 30 is furthermore operative on supply drum 4, which stop element is pressed against the supply drum surface at the end of the insertion process, that is, when the end of the weft yarn has reached the end of the shed, so that further unwinding of the yarn from the supply drum is stopped.

Figure 2:
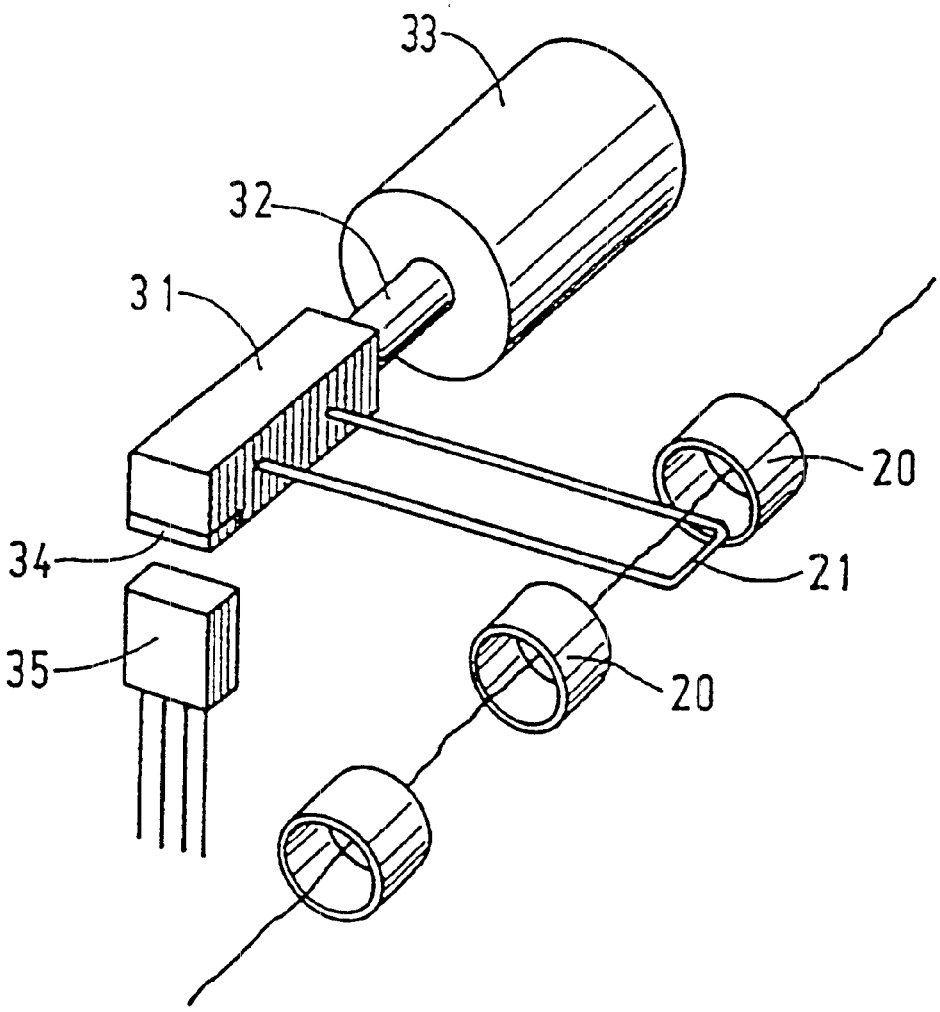
FIG. 2 is a perspective, schematic view of an embodiment of an insertion brake.

One embodiment of an insertion brake which can be used in the loom according to FIG. 1 is shown in FIG. 2. Said figure shows the manner in which a lever 21 in the form of a fork is capable of movement between two fixedly disposed yarn guides 20. Lever 21 is fitted with a block 31 on its other side, which is mounted on a shaft 32 of a solenoid motor 33. Block 31 is fitted with a magnet 34, which cooperates with a sensor 35. Although a solenoid electric motor is used for driving the movable brake element 21 in this embodiment, it will be apparent that also other types of electric motors can be used, even hydraulic or pneumatic motors may be used.

The operation of the insertion brake according to the invention will now be explained in more detail with reference to FIG. 3. As already said before, the moment yarn 1 reaches the end of the shed, that is, the moment stop element 30 comes into operation, very high tension peaks occur in yarn 1 in looms which do not employ an insertion brake, because the kinetic energy contained in the yarn converts into tension. The trend of the yarn tension, that is, in the situation wherein no brake is used, is schematically shown in FIG. 3*d*, from which it is apparent that during the first part of the insertion process the tension in the yarn is at a low level, after which the tension runs up very high at moment S, which is the moment the stop element becomes operative. The insertion brake is intended to remove the kinetic energy contained in the yarn altogether or partly before the stop element 30 becomes operative. In order to achieve this with the desired precision, the movable brake element must follow a precisely defined motion pattern. These desired motion patterns may vary with different yarn qualities and different operating conditions. A time-position diagram of the movable brake element 21 for a specific yarn type is shown in FIG. 3*a*. The figure shows, seen from the left-hand side, the brake element 21 to occupy its position of rest first, in which position the yarn is hardly deflected from its path, if at all, and at moment R, that is, some time before moment S at which the stop element becomes operative, the brake element 21 must be moved from its position of rest to its maximum stroke position according to a time-position line which is to be followed exactly. The time-position diagram for brake element 21 is stored in programme section 26 of the electronic control device 25. The instantaneous position of the brake element 21 is continuously sensed and transmitted, via sensor 24, to the electronic device 25, where said instantaneous position is compared with the position as desired according to the time-position diagram. Upon detection of a deviation between the desired position and the instantaneous position, the electronic device 25 will control the excitation of the driving unit 23 in such a manner that the deviation will be at least substantially eliminated. The trend of the excitation of the driving device 23 as it occurs in practice is shown in FIG. 3*b*. The trend of the tension in the yarn as it occurs when an insertion brake according to the invention is used is shown in FIG. 3*c*, from which it appears that the tension peaks that now occur are only very small, in any case much smaller than in the situation of an non-retarded yarn as shown in FIG. 3*d*.

Figures 3A, 3B, 3C, 3D:
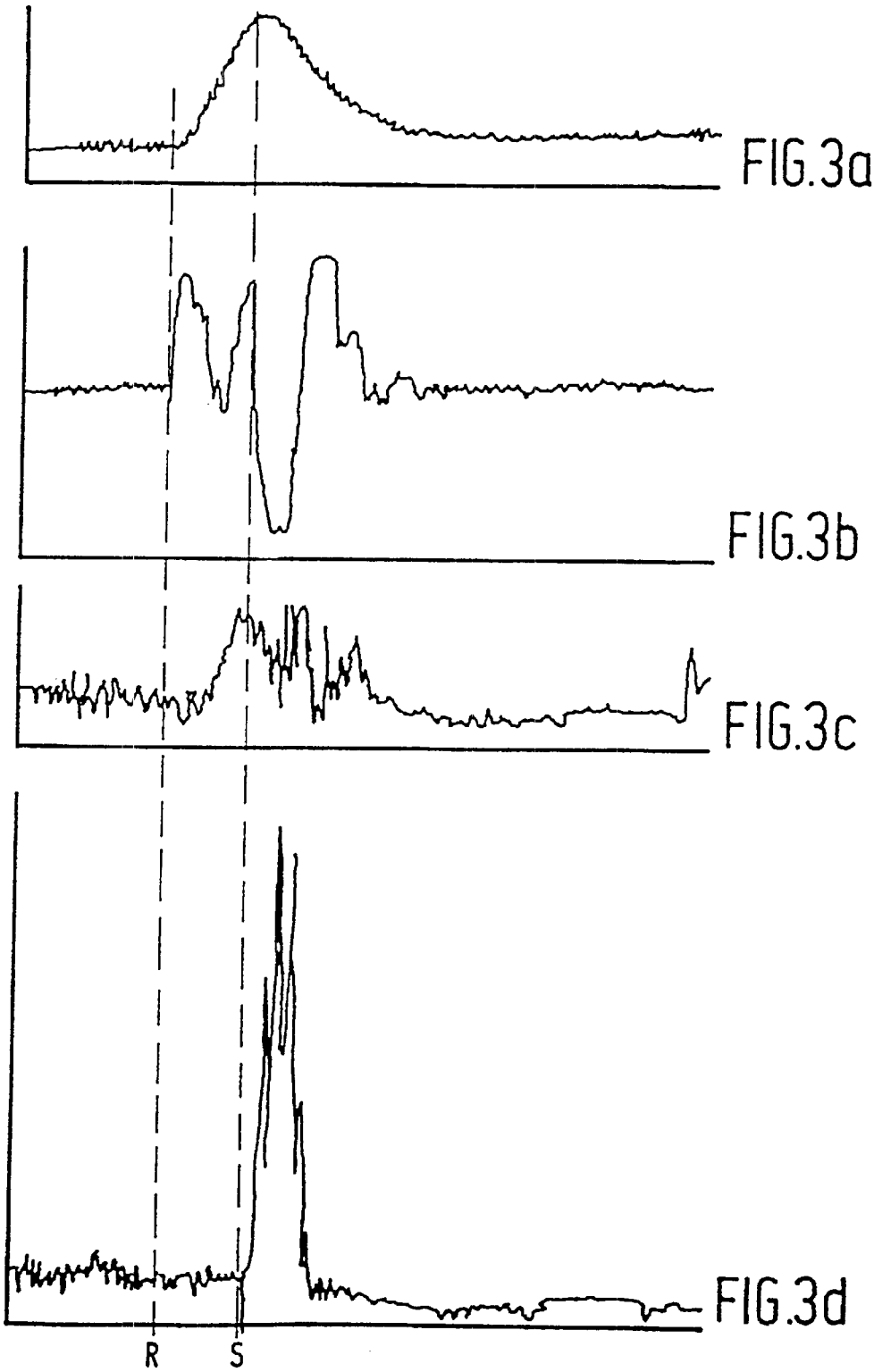
FIGS. 3*a*–3*d* successively show an example of a time-position diagram of the movable brake element; the trend of the excitation of the driving device of the movable element; the trend of the tension in a braked yarn and finally the trend of the tension in a non-braked yarn.

In the embodiment which is discussed with reference to FIG. 3, only one possible time-position diagram for the movable brake element is illustrated in FIG. 3*a*. It will be apparent that several time-position diagrams, for example for different yarn types, may be stored in the programme section of the electronic device.

The moment the end of the insertion process is reached will vary slightly as the speed at which the yarn is carried through the shed varies. This means that also moment S, at which the stop element becomes operative, will exhibit some degree of variation. In order to take this into account, the electronic device 25 will adapt the point R at which the brake 21 is put into operation to said variation and shift it to such an extent that the distance between points R and S will remain substantially constant. Possibly, the electronic device can adjust the excitation of the driving device so that the gradient of the line between the moment the brake 21 is put into operation and the moment it reaches its maximum stroke position will become steeper or less steep as moment S occurs sooner or later, respectively. Brake 21 thus ensures that the kinetic energy contained in the yarn is reduced accurately and in time.

The signal which tells that the end of the insertion process is nearing, the signal of point R, therefore, can for example be delivered by a sensor which counts the number of windings being unwound from supply drum 4. One or two windings before the end of the insertion process, said sensor signals to the electronic control device that point R has been reached, whereupon the brake is excited. Possibly such a signal can also be obtained by means of one or more sensors disposed in the shed, which sense the passage of the yarn end at a location some distance away from the end of the shed and transmit this as a signal of point R to the electronic control device. Although the electronic control device is represented as a separate block in this embodiment, it will be apparent that it may form an integrated part of the overall control apparatus of the loom.

According to the invention, the brake is so arranged that the moment of mass inertia of the brake element 21 and the parts connected thereto is so low that any irregularities in the yarn, such as thickenings, which strike against the brake element 21, are capable of moving the brake element 21 temporarily, so that such thickenings can pass the brake element without any undesirably high yarn tensions occurring.

The sensor 24, together with the electronic system 25, will detect a deviation between the instantaneous position and the desired position in that case and immediately undertake a control action in order to offset the deviation between the instantaneous position and the desired position.

Thus an insertion brake is obtained which exactly follows a prescribed time-position diagram and which still is sufficiently flexible to be able to cope with operating conditions that may suddenly occur.

Although the insertion brake according to the invention is described herein as being used in an air jet loom, said brake can also be used in water jet looms and other types of looms whilst retaining its advantages.

Figure 4A:
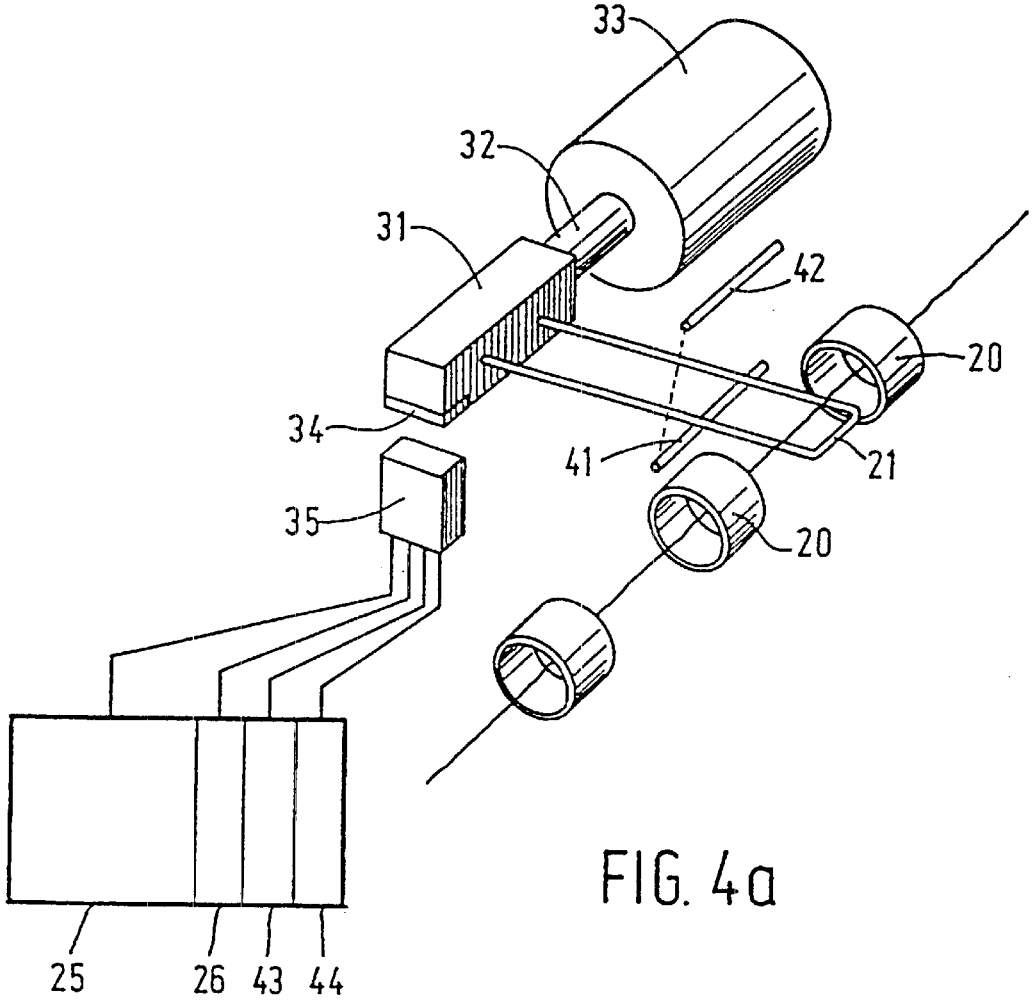
FIGS. 4*a* and 4*b* show another embodiment of an insertion brake.
Figure 4B:
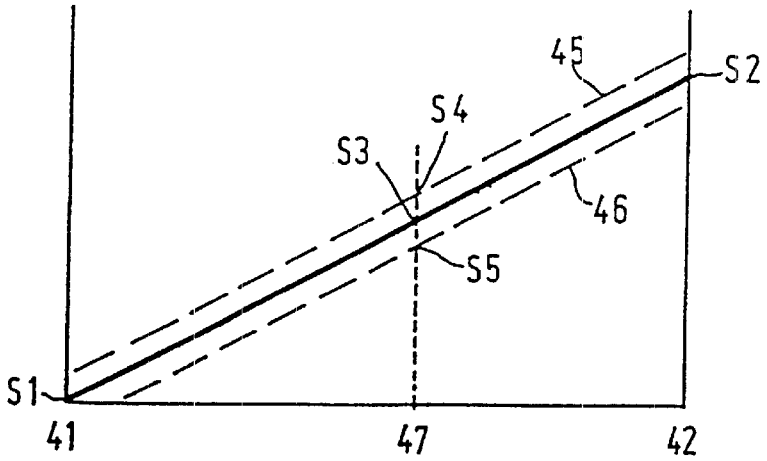

FIG. 4 schematically shows an insertion brake similar to the one which is shown in FIG. 2, wherein a first stroke-limiting stop 41 is disposed on one side of the movable element 21 and a second stop 42 is disposed on the other side thereof. As is furthermore shown in the figure, position detection sensor 35 is connected to the schematically indicated electronic control device 25 including the aforesaid programme section 26 of the time-position programme as well as a control module 43 for adjusting the position detection sensor 35 and a function verification module 44 for verifying the correct functioning of the brake. When the brake is placed into service, or following the replacement of sensor 35, the movable brake element 21 is first moved to a position in which it abuts against first stop 41. In this position, position detection sensor 35 will deliver a first (zero) signal S1, which is supplied to and stored in control module 43. Then the movable brake element 21 is moved to a position in which it abuts against a second stop 42, whereby position detection sensor 35 delivers a second signal S2 for the maximum stroke position of the brake element, which signal is likewise transmitted to control module 43. In control module 43 the difference between S1 and S2 is determined, which difference signal is a measure of the total stroke (100%) of the brake element, therefore. Then the device can be placed into service, whereby the position detection sensor delivers a signal for every current position. Each of said signals is now converted in module 43 into a percentage of the difference between signals S1 and S2, and thus into a percentage of the total stroke (100%) of the brake element. All this is graphically represented in the diagram of FIG. 4*b*, wherein the spacing between stops 41 and 42 is shown on the horizontal axis, whilst the vertical axis shows the signals that are generated by the position detection sensor 35. It will be apparent from this diagram that a signal S3 which is delivered upon a specific current position 47 represents a certain percentage of the difference between S1 and S2. This percentage is converted in module 43 into a similar percentage of the distance between position 41 and position 42, which amounts to position 47, therefore.

When a new sensor 35 is fitted, this new sensor may generate slightly higher or lower signals, the trend of which signals will be as illustrated in dotted lines 45 or 46 in FIG. 4*b*. Although these signals will be higher or lower than the signals obtained with the previous sensor, the same percentages will nevertheless be obtained, due to the conversion process as explained before, so that eventually the correct position will be obtained. Thus, a first sensor will generate a signal S3, which more or less corresponds to 50% of the difference between S1 and S2, from which it results that position 47 amounts to approximately 50% of the stroke between 41 and 42. Another sensor will generate a signal S4 or S5, which will also correspond to 50% of the difference between the associated minimum and maximum stroke position signals. Also in this case this will result in 50% of the difference between the minimum and the maximum stroke position, that is, in position 47. The same takes place for every current position of the brake element.

Thus an insertion brake has been obtained wherein the influence of deviating sensor characteristics on the control system is eliminated completely independently by initial adjustment of the sensors.

After having been placed into service, the movable brake element will not come into contact with the stops 41 and 42 any more, but it will move within a range of 20–80% of the maximum stroke. In order to be able to verify whether the brake is functioning properly, it can be established via control module 44 whether the movable brake element makes a specific stroke within a specific period of time, for example stroke amounting to 50–80% of the maximum stroke.

What is claimed is:

1. A loom with an insertion brake disposed between a yarn feeder and a shed of the loom, said loom comprising:

a movable brake element movable between two fixedly disposed yarn guides from a position of rest to an operative position, the movable brake element being connected to a driving motor, excitation of the driving motor by current being controlled by an electronic system, at least one program for a predetermined time and a predetermined position of the movable brake element being incorporated in said electronic system, the electronic system including a position detection sensor for sensing an instantaneous position of the brake element and generating an instantaneous brake element position signal, the electronic system comparing the instantaneous brake element position signal with a desired predetermined position of the movable brake element according to the program and, if a deviation is established by the electronic system between the sensed instantaneous brake element position and the desired predetermined position of the movable brake element, the electronic system controlling an amount of current being supplied to the driving motor so that said deviation between the sensed instantaneous position of the brake element and the desired predetermined position of the movable brake element is at least largely eliminated.

2. The loom according to claim 1, wherein the movable brake element includes one end of a lever rotatable about a shaft, said shaft is linked to a rotary solenoid motor.

3. The loom according to claim 1, wherein the movable brake element is movable from the position of rest to a maximum stroke position by the electronic system controlling the amount of current to the driving motor so that the maximum stroke position is reached quickly.

4. The loom according to claim 1, wherein a mass inertia of the movable brake element is low so that a force exerted on the movable brake element is capable of quickly moving the movable brake element upon detection of irregularities in the yarn.

5. The loom according to claim 3, wherein the movable brake element is movable between a first stop and a second stop, and the electronic system includes a control module for adjusting the position detection sensor, the control module first storing a first signal from the position detection sensor when the movable brake element abuts against said first stop, and the control module records a second signal when the movable brake element abuts against said second stop, a difference signal between said first and second signal is stored as a maximum value of a path through which the movable brake element travels, the control module converts the instantaneous brake element position signal to a percentage of said difference signal, from which the instantaneous position of the movable brake element follows as a percentage of the maximum stroke position of the movable brake element, which momentary position is compared with the desired predetermined position by the electronic system.

6. The loom according to claim 1, wherein a specific position change of the movable brake element is verified for a specified period of time.

* * * * *